US009933724B2

(12) United States Patent
Ohshika et al.

(10) Patent No.: US 9,933,724 B2
(45) Date of Patent: Apr. 3, 2018

(54) IMAGE FORMING APPARATUS AND IMAGE FORMING METHOD WITH DEVELOPING VOLTAGE CORRECTION PROCESSING

(71) Applicant: Oki Data Corporation, Tokyo (JP)

(72) Inventors: Hirotaka Ohshika, Tokyo (JP); Takeshi Ishii, Tokyo (JP); Shunsuke Sasaki, Tokyo (JP); Tamaki Miyata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/269,049

(22) Filed: Sep. 19, 2016

(65) Prior Publication Data

US 2017/0090344 A1 Mar. 30, 2017

(30) Foreign Application Priority Data

Sep. 28, 2015 (JP) ..... 2015-189929

(51) Int. Cl.
*G03G 15/08* (2006.01)
*G03G 15/00* (2006.01)
*G03G 15/01* (2006.01)

(52) U.S. Cl.
CPC ..... *G03G 15/0831* (2013.01); *G03G 15/505* (2013.01); *G03G 15/0136* (2013.01); *G03G 15/6585* (2013.01); *G03G 2215/00949* (2013.01)

(58) Field of Classification Search
CPC ..... G03G 15/505; G03G 15/0831; G03G 15/1605; G03G 15/0136; G03G 15/6585; G03G 2215/00949
USPC ..... 399/53, 302, 317
See application file for complete search history.

(56) References Cited

U.S. PATENT DOCUMENTS 8,811,867 B2 * 8/2014 Ichihashi ..... G03G 15/161 399/302

FOREIGN PATENT DOCUMENTS

| | | | |
|---|---|---|---|
| JP | 2003295597 | A | 10/2003 |
| JP | 2005266749 | A | 9/2005 |
| JP | 2007121906 | A | 5/2007 |
| JP | 2011-112797 | A | 6/2011 |

* cited by examiner

*Primary Examiner* — Hoang Ngo
(74) *Attorney, Agent, or Firm* — Panitch Schwarze Belisario & Nadel LLP

(57) ABSTRACT

An image forming apparatus includes an image forming section, a transferring member, and a controller. The image forming section includes an image supporting member and a developer supporting member. The image supporting member supports a latent image on a surface of the image supporting member. The developer supporting member supports, on a surface of developer supporting member, a developer that develops the latent image. The transferring member transfers, onto a transferred medium as a medium on which a transfer is to be performed, an image formed by the image forming section. The controller controls, as an amount of the developer, a developer amount to be fed to the latent image supported on the surface of the image supporting member, on the basis of a traveling velocity of the transferred medium.

18 Claims, 12 Drawing Sheets

TB1

| BELT TRAVELING VELOCITY | COLOR | PRINTING MODE (1) | PRINTING MODE (2) | PRINTING MODE (3) | PRINTING MODE (4) | PRINTING MODE (5) | PRINTING MODE (6) | PRINTING MODE (7) | PRINTING MODE (8) |
|---|---|---|---|---|---|---|---|---|---|
| 180 mm/s OR HIGHER | Y | 0 | 0 | SEPARATED | SEPARATED | -15 | 0 | SEPARATED | SEPARATED |
| | M | 0 | 0 | SEPARATED | SEPARATED | -10 | 0 | SEPARATED | SEPARATED |
| | C | 0 | 0 | SEPARATED | SEPARATED | -10 | 0 | SEPARATED | SEPARATED |
| | K | 0 | 0 | 0 | SEPARATED | -25 | 0 | 0 | SEPARATED |
| | W | 0 | SEPARATED | SEPARATED | 50 | 50 | SEPARATED | SEPARATED | 50 |
| 130 mm/s OR HIGHER AND LOWER THAN 180 mm/s | Y | -15 | -15 | SEPARATED | SEPARATED | -40 | -15 | SEPARATED | SEPARATED |
| | M | -15 | -15 | SEPARATED | SEPARATED | -35 | -15 | SEPARATED | SEPARATED |
| | C | -5 | -5 | SEPARATED | SEPARATED | -15 | -5 | SEPARATED | SEPARATED |
| | K | 0 | 0 | 0 | SEPARATED | -30 | 0 | 0 | SEPARATED |
| | W | -15 | SEPARATED | SEPARATED | 50 | 50 | SEPARATED | SEPARATED | 50 |
| LOWER THAN 130 mm/s | Y | -45 | -45 | SEPARATED | SEPARATED | -85 | -45 | SEPARATED | SEPARATED |
| | M | -30 | -30 | SEPARATED | SEPARATED | -60 | -30 | SEPARATED | SEPARATED |
| | C | -10 | -10 | SEPARATED | SEPARATED | -35 | -10 | SEPARATED | SEPARATED |
| | K | 0 | 0 | 0 | SEPARATED | -35 | 0 | 0 | SEPARATED |
| | W | -35 | SEPARATED | SEPARATED | 50 | 50 | SEPARATED | SEPARATED | 50 |

FIG. 3

TB101

| BELT TRAVELING VELOCITY | COLOR | FOUR-COLOR PRINTING | MONOCHROME PRINTING |
|---|---|---|---|
| 180 mm/s OR HIGHER | Y | 0 | SEPARATED |
| | M | 0 | SEPARATED |
| | C | 0 | SEPARATED |
| | K | 0 | 0 |
| 130 mm/s OR HIGHER AND LOWER THAN 180 mm/s | Y | -15 | SEPARATED |
| | M | -15 | SEPARATED |
| | C | -5 | SEPARATED |
| | K | 0 | 0 |
| LOWER THAN 130 mm/s | Y | -45 | SEPARATED |
| | M | -30 | SEPARATED |
| | C | -10 | SEPARATED |
| | K | 0 | 0 |

FIG. 19

IMAGE FORMING APPARATUS AND IMAGE FORMING METHOD WITH DEVELOPING VOLTAGE CORRECTION PROCESSING

CROSS REFERENCE TO RELATED APPLICATIONS

This application claims the benefit of Japanese Priority Patent Application JP 2015-189929 filed on Sep. 28, 2015, the entire contents of which are incorporated herein by reference.

BACKGROUND

The invention relates to an image forming apparatus and an image forming method, and may be suitably applied to an image forming apparatus such as a printer and a copier that use an electro-photography system.

In an existing image forming apparatus using an electro-photography system, an image forming unit that forms a toner image is provided detachably on a main body of the image forming apparatus, and the toner image developed on a photosensitive drum of the image forming unit is transferred to and fixed on a recording medium. In an image forming apparatus that forms a color image, an image forming unit of a spot-color such as white and transparent is detachably provided on a main body of the image forming apparatus, in addition to image forming units of black, yellow, magenta, and cyan, and toner images of the respective colors are overlapped with one another on an intermediate transfer belt to form a color image. Although the plurality of image forming units are normally in contact with the intermediate transfer belt, separating the image forming unit of unused color from the intermediate transfer belt prevents attachment of fogging toner and prolongs lifetime of the image forming unit.

In such an image forming apparatus, a phenomenon called reverse transfer occurs in which a part of the toner transferred from the image forming unit to the intermediate transfer belt is collected by the other image forming unit that is located on the downstream side in a belt traveling direction and is in contact with the intermediate transfer belt. This causes the image density to become lower than a desired value. Thus, an existing image forming apparatus transfers an image density adjusting pattern in response to change in the contact-separation state of the image forming unit to the intermediate transfer belt, and corrects an image forming condition on the basis of a detected image density, thereby offsetting the decrease in image density by the reverse transfer irrespective of the contact-separation state of the image forming unit to obtain appropriate image density. For example, reference is made to Japanese Unexamined Patent Application Publication No. 2011-112797.

SUMMARY

In the existing image forming apparatus, however, the image density adjusting pattern is created in order to adjust the image density. This consumes toner every time the contact-separation state of the image forming unit to the intermediate transfer belt is changed, as well as causes downtime until start of printing.

It is desirable to provide an image forming apparatus and an image forming method that make it possible to improve functionality.

An image forming apparatus according to an illustrative embodiment of the invention includes: an image forming section including an image supporting member and a developer supporting member, in which the image supporting member supports a latent image on a surface of the image supporting member, and the developer supporting member supports, on a surface of developer supporting member, a developer that develops the latent image; a transferring member that transfers, onto a transferred medium as a medium on which a transfer is to be performed, an image formed by the image forming section; and a controller that controls, as an amount of the developer, a developer amount to be fed to the latent image supported on the surface of the image supporting member, on a basis of a traveling velocity of the transferred medium.

An image forming method according to an illustrative embodiment of the invention includes: forming an image by an image supporting member and a developer supporting member, in which the image supporting member supports a latent image on a surface of the image supporting member, and the developer supporting member supports, on a surface of the developer supporting member, a developer that develops the latent image; transferring the formed image onto a transferred medium as a medium on which a transfer is to be performed; and controlling, as an amount of the developer, a developer amount to be fed to the latent image supported on the surface of the image supporting member, on a basis of a traveling velocity of the transferred medium.

BRIEF DESCRIPTION OF THE DRAWINGS

FIG. 3 is a diagram illustrating a developing voltage correction value table.

FIG. 19 is a diagram illustrating a developing voltage correction value table according to another embodiment.

DETAILED DESCRIPTION

Hereinafter, some embodiments of the invention are described with reference to drawings.

1. Embodiment

[1-1. Configuration of Image Forming Apparatus]

Figure 1:
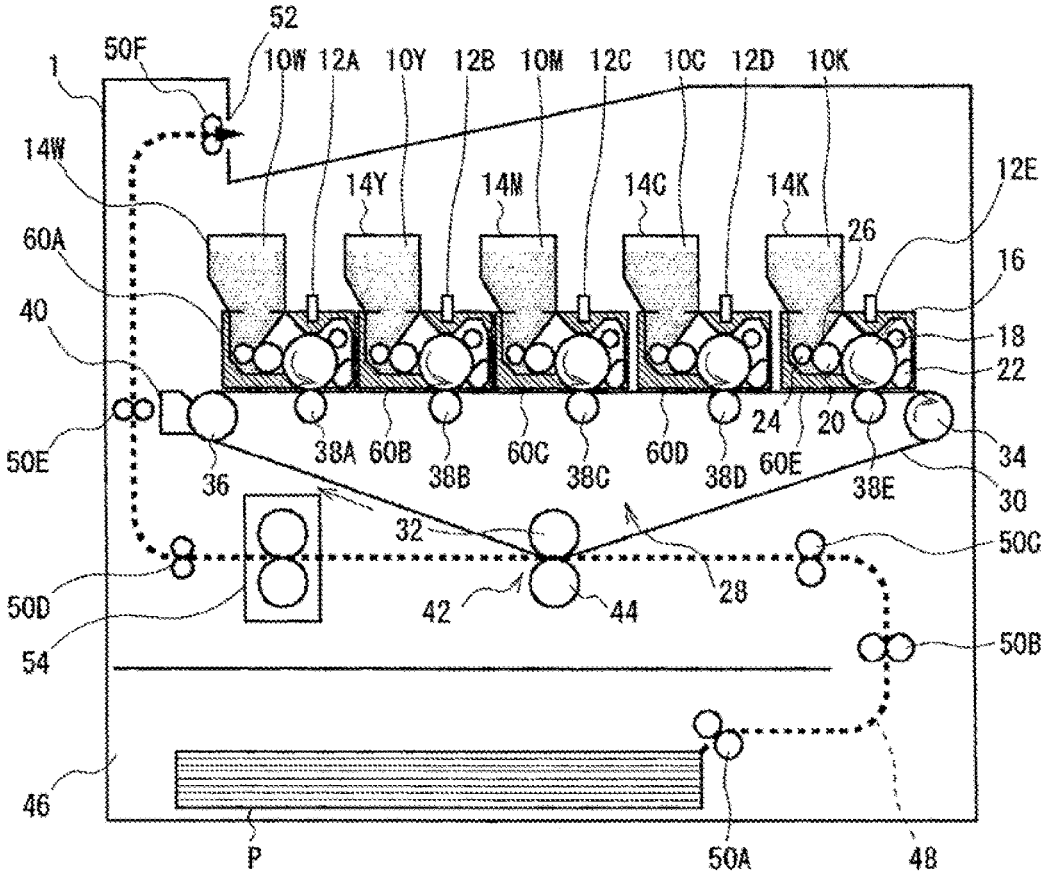
FIG. 1 is a side view illustrating a configuration of an image forming apparatus.

As illustrated in FIG. 1, an image forming apparatus 1 may be an electrophotographic five-color printer, and unit enclosures 60 that contain respective image forming units 10 (10W, 10Y, 10M, 10C, and 10K) may be disposed in order of unit enclosures 60A, 60B, 60C, 60D, and 60E from upstream side in a moving direction of an intermediate transfer belt 30. The image forming units 10W, 10Y, 10M, 10C, and 10K that respectively form images of white (W), yellow (Y), magenta (M), cyan (C), and black (K) may be detachably contained in the corresponding unit enclosures 60 (60A, 60B, 60C, 60D, and 60E). LED heads 12A, 12B, 12C, 12D, and 12E may be disposed in the respective image forming units 10, and toner containers 14 (14W, 14Y, 14M, 14C, and 14K) may be detachably attached to the respective image forming units 10. The toner containers 14 (14W, 14Y, 14M, 14C, and 14K) each may contain a toner, as a developer, having a color that corresponds to corresponding one of the image forming units 10.

The toner may be formed of a polyester resin, a colorant, a charge controlling agent, and a mold releasing agent, and may be negatively-charged powder that is added with an external additive (hydrophobic silica) and has an average particle diameter of about 6 μm. Colorants of the colors Y, M, C, and K each may be made of an organic material, and may be a pigment that is transparent to some extent for mixture of colors to produce any color. Examples of the organic materials for the colorants of the colors Y, M, C, and K may include pigment yellow, pigment cyan, pigment magenta, and carbon black. The colorant of the color W may be an opaque colorant that may be a metal-based pigment such as titanium oxide.

The unit enclosure 60 of each of the image forming units 10 may be changed depending on a type of a recording medium P to be used. For example, in a case where a transparent film is used as the recording medium P and a white image is to be overlaid on color images of the colors Y, M, C, and K, on the recording medium P, the image forming units 10 may be housed in the unit enclosure 60A to the unit enclosure 60E in order of the colors W, Y, M, C, and K, in the image forming unit 1. In contrast, in a case where, for example, color paper is to be used as the recording medium P and the color images are to be formed on the white image on the recording medium P, the image forming units 10 may be contained in the unit enclosure 60A to the unit enclosure 60E in order of the colors Y, M, C, K, and W, in the image forming apparatus 1. In the following, a direction from the unit enclosure 60A toward the unit enclosure 60E is referred to as a downstream direction, and a direction from the unit enclosure 60E toward the unit enclosure 60A is referred to as an upstream direction.

Figure 2:
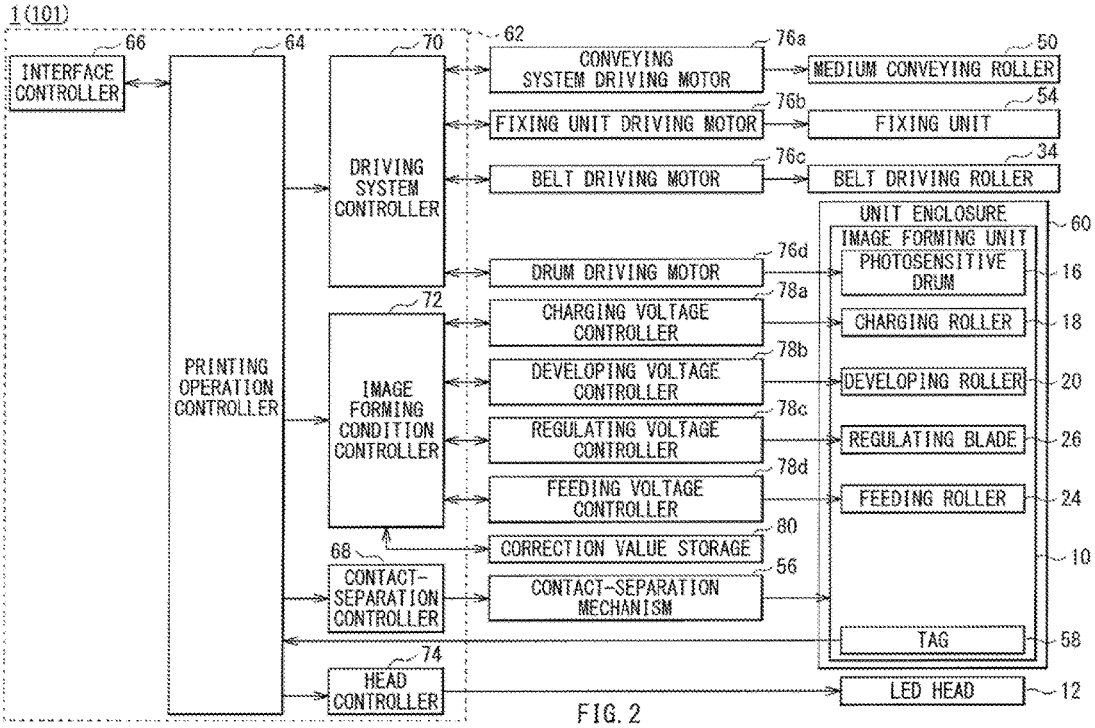
FIG. 2 is a block diagram illustrating a control system relating to image forming operation of the image forming apparatus.

The image forming units 10 may have a common internal configuration to each other. A charging roller 18 serving as a charging member, a developing roller 20 serving as a developer supporting member, and a cleaning section 22 may be disposed around a photosensitive drum 16 serving as an image supporting member as illustrated in FIG. 1 and FIG. 2. The photosensitive drum 16 may be formed of a conductor such as aluminum coated with a photosensitive layer, and may include a driving coupling at an axial end thereof to be disposed rotatably. The charging roller 18 may be formed of, for example, a metal such as stainless steel as a shaft coated with an electro-conductive elastic body, and rotate in conjunction with the photosensitive drum 16. The developing roller 20 may be formed of, for example, a metal such as stainless steel as a shaft coated with an electro-conductive elastic body such as urethane, and may include a gear at an end of the shaft. The developing roller 20 may rotate through drive force transmitted from the photosensitive drum 16. A feeding roller 24 and a regulating blade 26 may be further disposed around the developing roller 20. The feeding roller 24 may be formed of, for example, a metal such as stainless steel as a shaft coated with a foamed elastic body such as silicon, and may include a gear at an end of the shaft. The feeding roller 24 may rotate through drive force transmitted from the developing roller 20. The regulating blade 26 may be an elastic blade that is formed of, for example, a stainless steel thin plate, and has an end fixed to a holder. The regulating blade 26 may be disposed to allow the other end to be pressed against the developing roller 20. The cleaning section 22 may include an elastic blade as one of components, and the elastic blade may be in contact with the photosensitive drum 16.

Each of the image forming units 10 may be movable in a vertical direction by a corresponding contact-separation mechanism 56. Each of the image forming units 10 may be normally disposed to allow the photosensitive drum 16 to be in contact with the intermediate transfer belt 30, and may be moved upward by the contact-separation mechanism 56 to be separated away from the intermediate transfer belt 30. The image forming apparatus 1 has eight printing modes, namely, a printing mode (1), a printing mode (2), a printing mode (3), a printing mode (4), a printing mode (5), a printing mode (6), a printing mode (7), and a printing mode (8) that depend on locations at which the respective image forming units 10 are placed and contact-separation states of the respective image forming units 10 with respect to the intermediate transfer belt 30. The printing mode (1) corresponds to W-uppermost five-color printing, the printing mode (2) corresponds to W-uppermost four-color printing, the printing mode (3) corresponds to W-uppermost monochrome printing, the printing mode (4) corresponds to W-uppermost spot-color printing, the printing mode (5) corresponds to W-lowermost five-color printing, the printing mode (6) corresponds to W-lowermost four-color printing, the printing mode (7) corresponds to W-lowermost monochrome printing, and the printing mode (8) corresponds to W-lowermost spot-color printing. Table 1 illustrates relationship between the locations (the unit enclosures 60) of the respective image forming units 10 and the contact-separation states of the respective image forming units 10 to the intermediate transfer belt 30, in each printing mode. In Table 1, "separated" refers to a state in which the image forming unit 10 is separated away from the intermediate transfer belt 30. In the following, a state in which the image forming unit 10 is in contact with the intermediate transfer belt 30 is also referred to as a contact state.

TABLE 1

| Location and Printing Mode | 60A | 60B | 60C | 60D | 60E |
|---|---|---|---|---|---|
| (1) W-uppermost five-color printing | W | Y | M | C | K |
| (2) W-uppermost four-color printing | Separated | Y | M | C | K |
| (3) W-uppermost monochrome printing | Separated | Separated | Separated | Separated | K |
| (4) W-uppermost spot-color printing | W | Separated | Separated | Separated | Separated |
| (5) W-lowermost five-color printing | Y | M | C | K | W |
| (6) W-lowermost four-color printing | Y | M | C | K | Separated |
| (7) W-lowermost monochrome printing | Separated | Separated | Separated | K | Separated |
| (8) W-lowermost spot-color printing | Separated | Separated | Separated | Separated | W |

Each of the image forming units 10 further has a tag 58 that allows the image forming apparatus 1 main body to identify that the image forming unit 10 contains which color of toner, out of the colors W, K, Y, M, and C.

The LED heads 12 (12A, 12B, 12C 12D, and 12E) have a common configuration, and each may be configured of a printed circuit board on which a plurality of LED array chips are arranged, and a rod lens array that focuses light emitted from the LED array onto a surface of the photosensitive drum 16 at the same magnification. An intermediate transferring section 28 may be configured of a secondary transferring counter roller 32, a belt driving roller 34, a tension roller 36, and the endless intermediate transfer belt 30 that is rotatably supported by the secondary transferring counter roller 32, the belt driving roller 34, and the tension roller 36. Each of primary transferring rollers 38 (38A, 38B, 38C, 38D, and 38E) may be formed of a metal shaft coated with an electro-conductive elastic body, and disposed at a position opposed to the photosensitive drum 16 such that each of the primary transferring roller 38 comes into contact with an inner peripheral surface of the intermediate transfer belt 30 to form a primary transferring nip with the photosensitive drum 16 of the corresponding color. A secondary transferring section 42 has a secondary transferring roller 44 that is formed of a metal shaft coated with an electro-conductive elastic body. The secondary transferring roller 44 may be so disposed as to come into contact with the intermediate transfer belt 30 at a position opposed to the secondary transferring counter roller 32 to rotate in the direction same as the moving direction of the intermediate transfer belt 30. The transferring cleaning section 40 may be disposed downstream of the contact position of the secondary transferring roller 44 and upstream of the primary transferring roller 38A, in the moving direction of the intermediate transfer belt 30. An elastic blade as one of components of the transferring cleaning section 40 may be pressed against the surface of the intermediate transfer belt 30.

A medium container 46 that contains the recording medium P may be provided at a lower part of the image forming apparatus 1. A dashed line illustrated in FIG. 1 denotes a medium conveying path 48. A plurality of medium conveying rollers 50 (50A, 50B, 50C, 50D, 50E, and 50F) may be disposed along the medium conveying path 48. The recording medium P may be sequentially conveyed one by one in the medium conveying path 48 by the medium conveying rollers 50, and discharged from a discharge port 52 after being subjected to processes of secondary transfer and fixing. A fixing unit 54 includes a heating roller and a backup roller, and fixes the toners that have been transferred onto the recording medium P, on the recording medium P through pressure application and heating.

A controller 62 (FIG. 2) may be mainly configured of a central processing unit (CPU), and read out a predetermined program from a memory to execute the predetermined program, thereby controlling the respective sections to integrally control the image forming apparatus 1. The memory may be, for example, a read only memory (ROM), a random access memory (RAM), a hard disk drive, a flash memory, or any other suitable storage device.

A printing operation controller 64 controls entire image forming operation of the image forming apparatus 1. An interface controller 66 receives various kinds of signals and image data from an unillustrated external host apparatus through a driver, and transmits the received signals and image data to the printing operation controller 64. In addition, the printing operation controller 64 may receive color information of the toner included in each of the image forming units 10 that are disposed in the respective unit enclosures 60, from the tags 58 provided in the respective image forming units 10.

A contact-separation controller 68 controls driving of the contact-separation mechanisms 56 to change the position of the specific image forming unit 10 in the vertical direction, in accordance with the signal received from the printing operation controller 64. A driving system controller 70 transmits a driving signal to each of a conveying system driving motor 76*a*, a fixing unit driving motor 76*b*, a belt driving motor 76*c*, and a drum driving motor 76*d*, in accordance with printing timing that is generated by the printing operation controller 64. The conveying system driving motor 76*a* may be a drive source of the medium conveying rollers 50, the fixing unit driving motor 76*b* may be a drive source of the rollers in the fixing unit 54, the belt driving motor 76*c* may be a drive source of the belt driving roller 34, and the drum driving motor 76*d* may be a drive source of the photosensitive drum 16. In the following, the conveying system driving motor 76*a*, the fixing unit driving motor 76*b*, the belt driving motor 76*c*, and the drum driving motor 76*d* are also collectively referred to as driving motors 76.

Note that, in the present embodiment, the intermediate transfer belt 30 travels at the substantially same velocity as the traveling velocity of an outer peripheral surface of the photosensitive drum 16. An outer peripheral surface of the developing roller 20 travels at a traveling velocity about 1.4 times of the traveling velocity of the outer peripheral surface of the photosensitive drum 16. An image forming condition controller 72 transmits a signal that relates to a magnitude and application timing of an application voltage, to a charging voltage controller 78*a*, a developing voltage controller 78*b*, a regulating voltage controller 78*c*, and a feeding voltage controller 78*d* (in the following, these controllers are also collectively referred to as voltage controllers 78) for each of the image forming units 10, in accordance with the signal from the printing operation controller 64. Thereafter, the voltage controllers 78 apply a predetermined charging voltage, a predetermined developing voltage, a predetermined regulating voltage, and a predetermined feeding voltage respectively to the charging roller 18, the developing roller 20, the regulating blade 26, and the feeding roller 24, at respective desired timings. A head controller 74 controls light emitting operation of the LED heads 12, on the basis of the image data processed by the printing operation controller 64.

A correction value storage 80 stores a developing voltage correction value table TB1 illustrated in FIG. 3. The developing voltage correction value table TB1 includes correction values of the developing voltages to be applied to the respective image forming units 10, more specifically, developing voltage correction values ΔV (the unit thereof is [V]) that are correction values to offset influence of reverse transfer. The developing voltage correction values ΔV may be varied on the basis of the belt traveling velocity that is a traveling velocity of the intermediate transfer belt 30, more specifically, increase the amount of toner to be developed as the belt traveling velocity is decreased. Also, the developing voltage correction values ΔV may be varied on the basis of the printing mode, in addition to the belt traveling velocity. In the present embodiment, the belt traveling velocity of 230 mm/s may be set as a reference belt traveling velocity, the printing mode (1) may be set as a reference printing mode, and the developing voltage at the reference belt traveling velocity in the reference printing mode may be set as a reference developing voltage. The developing voltage correction values ΔV may be selected by the image forming condition controller 72 on the basis of a printing condition, and added to the reference developing voltage. As mentioned above, the developing voltage correction value table TB1 stores the developing voltage correction values ΔV that are varied on the basis of the operation condition of the image forming apparatus 1, namely, a combination of the locations of the image forming units 10 of the respective colors and the image forming units 10 that are in contact with the intermediate transfer belt 30, and the belt traveling velocity. It is to be noted that the negatively-charged toners may be used in the present embodiment. Thus, a toner development amount that is an amount of the toner to be developed onto the photosensitive drum 16 in each of the image forming unit 10 may be increased as the developing voltage is increased to negative side. Also, in the image forming apparatus 1, the toner development amount may be increased as the regulating voltage or the feeding voltage is increased to the negative side, and the toner development amount may be increased as the charging voltage is decreased to the negative side. Further, in the image forming apparatus 1, the toner development amount may be increased as the amount of the light emission of the LED heads 12 is increased.

[1-2. Developing Voltage Correction Processing]

Figure 4:
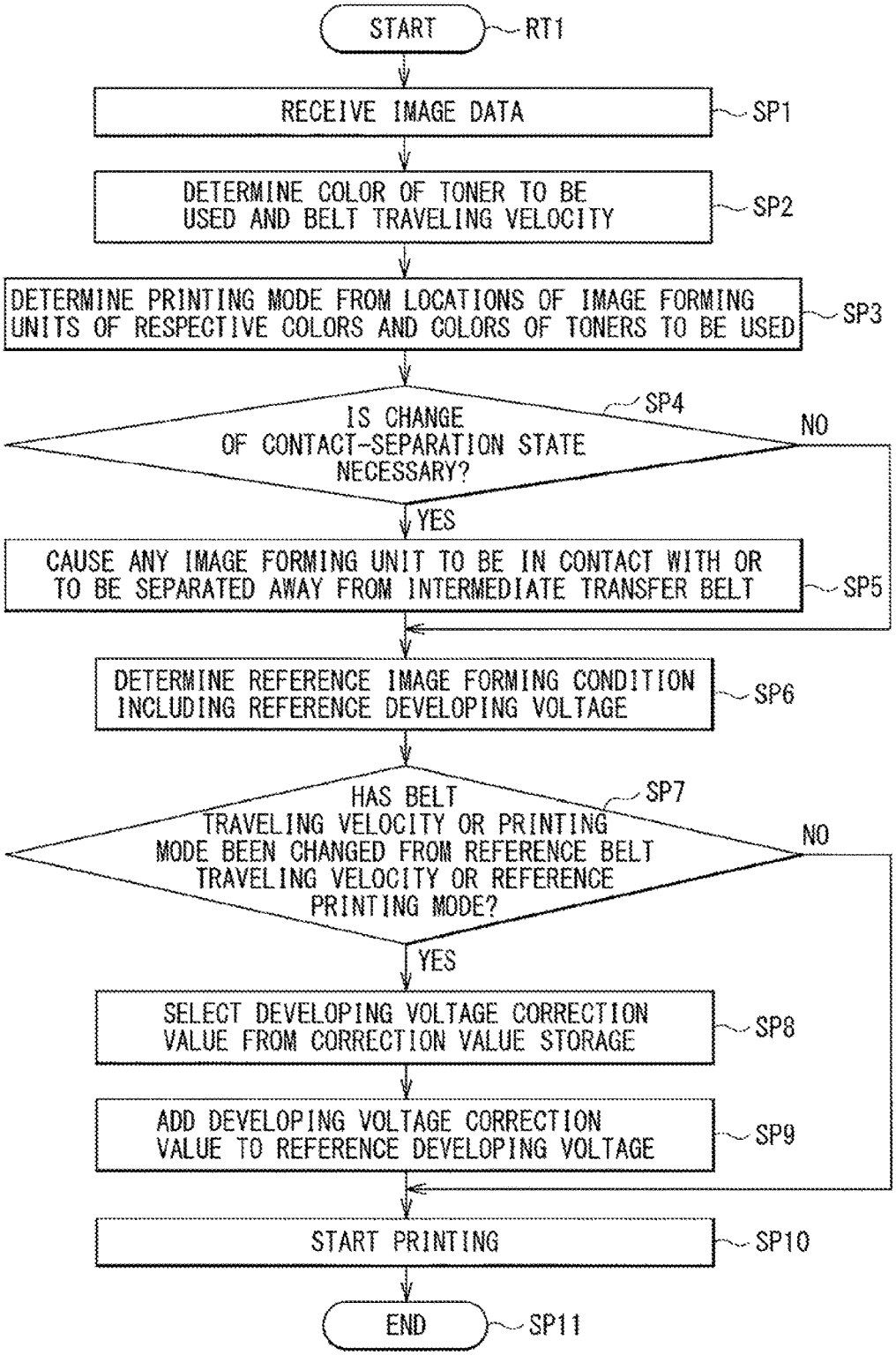
FIG. 4 is a flowchart illustrating a developing voltage correction processing procedure.

A specific but non-limiting processing procedure of developing voltage correction processing performed by the image forming apparatus 1 is described with reference to a flowchart of FIG. 4. The controller 62 reads out a developing voltage correction processing program from the ROM to execute the program, thereby starting a developing voltage correction processing procedure RT1. Then, the process proceeds to step SP1.

In step SP1, the controller 62 is in a standby state until the interface controller 66 receives image data from, for example, a personal computer as an unillustrated host apparatus and a printing instruction is received. Then, the process proceeds to step SP2. In step SP2, the controller 62 determines, by the printing operation controller 64, the color of the toner to be used for the image formation, on the basis of the received image data, and also determines, by the printing operation controller 64, the belt traveling velocity, on the basis of preset thickness information of the recording medium P. Then, the process proceeds to step SP3.

In step SP3, the controller 62 acquires, through the printing operation controller 64, color information of the toners of the image forming units 10 that are provided in the respective unit enclosures 60A to 60E from the tags 58, and determines the printing mode, on the basis of the locations of the image forming units 10 of the respective colors and the colors of the toners to be used. The process proceeds to step SP4. In step SP4, the controller 62 determines, by the printing operation controller 64, whether it is necessary to change the contact-separation state of each of the image forming units 10 relative to the intermediate transfer belt 30 from the current contact-separation state. When a denial result is obtained, the result represents that it is unnecessary to change the contact-separation state of each of the image forming units 10. At this time, the controller 62 skips the process in step SP5, and does not change the contact-separation state of each of the image forming units 10. Then, the process proceeds to step SP6. On the other hand, when an affirmative effect is obtained in step SP4, the result represents that it is necessary to change the contact-separation state of each of the image forming units 10. At this time, the process of the controller 62 proceeds to step SP5. In step SP5, the controller 62 transmits the determined printing mode from the printing operation controller 64 to the contact-separation controller 68. The contact-separation controller 68 drives the contact-separation mechanism 56 in each of the unit enclosures 60 in accordance with the printing mode. The contact-separation mechanism 56 lowers the position of the corresponding image forming unit 10 that is to be used in the image formation, thereby bringing the image forming unit 10 into contact with the intermediate transfer belt 30. At the same time, the contact-separation mechanism 56 raises the position of the corresponding image forming unit 10 that is not to be used in the image formation, thereby separating the image forming unit 10 from the intermediate transfer belt 30. Then, the process proceeds to step SP6. In step SP6, the controller 62 determines, by the image forming condition controller 72, an image forming condition that includes the reference developing voltage at the belt traveling velocity of 230 mm/s in the printing mode (1) as the reference operation condition, from the operation history of the image forming units 10 and temperature and humidity therearound. Then, the process proceeds to step SP7.

In step SP7, the controller 62 transmits the belt traveling velocity determined in step SP2 and the printing mode determined in step SP3, from the printing operation controller 64 to the image forming condition controller 72. The image forming condition controller 72 determines whether the belt traveling velocity or the printing mode has been changed from that of the reference operation condition (the reference belt traveling velocity or the reference printing mode). When a denial result is obtained, the result represents that the operation condition is the same as the reference condition, and it is unnecessary to correct the developing voltage. At this time, the controller 62 skips processes in steps SP8 and SP9, and does not correct the developing voltage. Then, the process proceeds to step SP10. When an affirmative result is obtained in step SP7, the result represents that the operation condition is different from the reference condition and it is necessary to correct the developing voltage. At this time, the process of the controller 62 proceeds to step SP8.

In step SP8, the controller 62 selects, by the image forming condition controller 72, the developing voltage correction value ΔV that corresponds to the belt traveling velocity and the printing mode, from the correction value storage 80. Then, the process proceeds to step SP9. In step SP9, the controller 62 adds, by the printing operation controller 64, the value of the developing voltage correction value ΔV to the currently-set reference developing voltage. The process proceeds to step SP10. In step SP10, the controller 62 starts printing through the printing operation controller 64. Then, the process proceeds to step SP11 to complete the developing voltage correction processing procedure RT1. Here, when the printing is to be performed after the developing voltage is corrected, the image forming condition controller 72 may reset the value of the regulating voltage and the value of the feeding voltage such that a difference between the feeding voltage and the developing voltage and a difference between the regulating voltage and the developing voltage are maintained to the same value before and after the developing voltage is corrected. Thereafter, the printing operation controller 64 may start printing with use of the corrected developing voltage. In contrast, when the printing is to be performed without performing correction of the developing voltage, the printing operation controller 64 does not correct the developing voltage from the reference developing voltage, and starts the printing with use of the reference developing voltage.

[1-3. Image Forming Processing]

After the developing voltage correction processing is completed, the printing operation controller 64 transmits the generated information on the printing timing and the printing speed, to the driving system controller 70. The driving system controller 70 causes the conveying system driving motor 76*a*, the fixing unit driving motor 76*b*, the belt driving motor 76*c*, and the drum driving motor 76*d* to rotate at respective predetermined timings and speeds, on the basis of the information on the printing timing and the printing speed. The rotation of the respective driving motors 76 may be transmitted to cause the medium conveying rollers 50, the rollers in the fixing unit 54, the belt driving roller 34, and the photosensitive drums 16 to rotate. Thus, the recording medium P may be started to be conveyed one by one in the medium conveying path 48. At this time, when the printing is to be performed on fifty pieces of A4 paper per minute, the belt traveling velocity and the traveling velocity of the outer peripheral surface of the photosensitive drum 16 may become 230 mm/s, and the traveling velocity of the outer peripheral surface of the developing roller 20 may become 322 mm/s.

At the same time, the image forming condition controller 72 provides a voltage control condition that is information on an application voltage and a voltage application timing, to the charging voltage controller 78*a*, the developing voltage controller 78*b*, the regulating voltage controller 78*c*, and the feeding voltage controller 78*d*. The voltage controllers 78 apply the predetermined voltages to the respective charging roller 18, developing roller 20, regulating blade 26, and feeding roller 24 at the predetermined timings, on the basis of the received voltage control condition. In the present embodiment, the negatively-charged toners may be used. Thus, the voltage controllers 78 may apply a negative polarity high voltage to each of the charging roller 18, the developing roller 20, the regulating blade 26, and the feeding roller 24, during the image formation. When the belt traveling velocity is set to the reference belt traveling velocity and the printing mode is set to the reference printing mode, a voltage illustrated in Table 2 may be applied to each of the image forming units 10. In contrast, when the developing voltage is corrected through the developing voltage correction processing, the developing voltage obtained from the addition of the developing voltage corrective value ΔV to the corresponding reference developing voltage illustrated in Table 2 may be applied to each of the image forming units 10. Note that the driving system controller 70 does not drive the drum driving motor 76*d* of the image forming unit 10 separated away from the intermediate transfer belt 30, and the voltage controllers 78 do not apply the voltages to the image forming unit 10 separated away from the intermediate transfer belt 30.

TABLE 2

| Color and Voltage | Y | M | C | K | W |
|---|---|---|---|---|---|
| Charging Voltage [V] | −1050 | −1050 | −1050 | −1050 | −1050 |
| Developing Voltage [V] | −210 | −180 | −150 | −165 | −245 |
| Regulating Voltage [V] | −305 | −275 | −245 | −260 | −400 |
| Feeding Voltage [V] | −305 | −275 | −245 | −260 | −400 |

Further, at the same time, the image data that has been first received by the printing operation controller 64 may be processed in the printing operation controller 64, and the processed image data may be transmitted to the head controller 74. The head controller 74 turns on each of the LED heads 12, on the basis of the received image data, thereby performing exposure of the surface of the photosensitive drum 16.

In each of the image forming units 10, the surface of the photosensitive drum 16 may be uniformly charged by the charging roller 18 supplied with the charging voltage. The charged photosensitive drum 16 may be exposed by the LED head 12, the exposed part thereof may be lowered in potential, and an electrostatic latent image corresponding to an image pattern may be accordingly formed. The electrostatic latent image may comes into opposition with the developing roller 20 that is applied with the developing voltage, and the toner may be developed on the electrostatic latent image by means of an electric field generated between the photosensitive drum 16 and the developing roller 20, which results in formation of the toner image. Note that, before the process mentioned previously, the toner may be frictionally charged by a contact part between the feeding roller 24 and the developing roller 20 and a contact part between the regulating blade 26 and the developing roller 20, and the charging amount per unit weight may become −30 μC/g. The frictionally-charged toner travels from the feeding roller 24 to the developing roller 20 by virtue of the electric field formed between the developing roller 20 and the feeding roller 24, and travels from the regulating blade 26 toward the developing roller 20 by virtue of the electric field formed between the developing roller 20 and the regulating blade 26. The regulating blade 26 also serves to regulate the thickness of the toner layer on the developing roller 20 to form the uniform toner thin layer on the developing roller 20. The developed toner image may be conveyed to a contact part between the photosensitive drum 16 and the intermediate transfer belt 30. Since a positive polarity high voltage is applied to the primary transferring roller 38, an electric field may be generated between the photosensitive drum 16 and the intermediate transfer belt 30, whereby the toner image may be subjected to a primary transfer onto the intermediate transfer belt 30. A small amount of toner remaining on the photosensitive drum 16 after the primary transfer may be removed by the cleaning section 22.

The toner image having been subjected to the primary transfer may be conveyed by the intermediate transfer belt 30 in a direction from the unit enclosure 60A to the unit enclosure 60E. In the case where the other image forming unit 10 is in contact with the intermediate transfer belt 30 downstream thereof, a phenomenon called reverse transfer occurs in which a part of the toner on the intermediate transfer belt 30 is collected by the image forming unit 10 located downstream. One reason for the occurrence of the reverse transfer is that positive charges caused by the primary transfer voltage is injected while the toner passes through the contact part between the photosensitive drum 16 of the image forming unit 10 on the downstream side and the intermediate transfer belt 30, and the toner is accordingly charged to positive polarity. In an existing apparatus, a density of the toner image formed by the image forming unit 10 on the upstream side may be decreased by the reverse transfer. In the present embodiment, however, the amount of the toner to be developed is increased through the correction of the developing voltage before the start of the image formation, to offset the influence of the reverse transfer, thereby obtaining appropriate image density eventually.

When the primary transfer of the toner images of the colors in use is completed, the toner images reach the secondary transferring section 42 through movement of the intermediate transfer belt 30. At the same time, the recording medium P also reaches the secondary transferring section 42. The secondary transferring roller 44 may be applied with a high voltage to generate an electric field with the secondary transferring counter roller 32 with the recording medium P and the intermediate transfer belt 30 in between, thereby performing a secondary transfer of the toner images formed on the intermediate transfer belt 30 onto the recording medium P. The toners remaining on the surface of the intermediate transfer belt 30 after the secondary transfer may be removed by the transferring cleaning section 40.

After the secondary transfer, the toner image may be conveyed, together with the recording medium P, to the fixing unit 54 along the medium conveying path 48, and fixed to the recording medium P by application of heat and pressure. Thereafter, the recording medium P on which the toner image has been fixed may be conveyed in the medium conveying path 48, discharged to the outside of the image forming apparatus 1 through the discharge port 52. Thus, the printing operation may be completed.

[1-4. Developing Voltage Correction]

Next, details on the developing voltage correction as a feature of one embodiment of the invention are described. As mentioned above, the developing voltage is corrected in order to increase the amount of the toner to be developed in consideration of the amount of the toner to be subjected to the reverse transfer, and thereby to obtain appropriate image density even when the toner having been subjected to the primary transfer is partially collected by the reverse transfer.

The amount of the toner to be subjected to the reverse transfer may be increased as the belt traveling velocity is decreased. This is presumably due to an increase in the time necessary for the toner to pass through the contact part between the photosensitive drum 16 and the intermediate transfer belt 30 and thus a large amount of charges are injected, when the belt traveling velocity is low. Therefore, to maintain the appropriate image density, it is desirable that the toner development amount be increased to increase the amount of the toner to be subjected to the primary transfer when the belt traveling velocity is lower than the reference belt traveling velocity. In contrast, when the belt traveling velocity is higher than the reference belt traveling velocity, it is desirable that the toner development amount be decreased to decrease the amount of the toner to be subjected to the primary transfer. Thus, for example, the color Y in the printing mode (1) in the developing voltage correction value table TB1 (FIG. 3) may have the developing voltage correction value ΔV of 0 V when the belt traveling velocity is 180 mm/s or higher, have the developing voltage correction value ΔV of −15 V when the belt traveling velocity is 130 mm/s or higher but lower than 180 mm/s, and have the developing voltage correction value ΔV of −45 V when the belt traveling velocity is lower than 130 mm/s. Therefore, the developing voltage correction value ΔV of the color Y may be increased to minus side (negative polarity side) as the belt traveling velocity is decreased.

Also, the amount of the toner that is to be subjected to the reverse transfer after being transferred to the intermediate transfer belt 30 by the predetermined image forming unit 10 may be increased as the number of the image forming units 10 that are in contact with the intermediate transfer belt 30 on the downstream side of the predetermined image forming unit 10 is increased. This is because the number of occurrence of reverse transfer is increased on the downstream side of the predetermined image forming unit 10. Thus, to maintain the appropriate image density, it is desirable that the toner development amount of the predetermined image forming unit 10 be increased as the number of the image forming units 10 that are in contact with the intermediate transfer belt 30 on the downstream side of the predetermined image forming unit 10 is increased. In contrast, it is desirable that the toner development amount of the predetermined image forming unit 10 be decreased as the number of the image forming units 10 that are in contact with the intermediate transfer belt 30 on the downstream side of the predetermined image forming unit 10 is decreased. Therefore, the color Y in a case where, for example, the belt traveling velocity is 180 mm/s or higher in the developing voltage correction value table TB1 (FIG. 3) may have the developing voltage correction value ΔV of 0 V in the printing mode (6), and have the developing voltage correction value ΔV of −15 V in the printing mode (5). Therefore, the developing voltage correction value ΔV of the color Y may be increased to minus side as the number of the image forming units 10 in the contacting state on the downstream side of the image forming unit 10Y is increased.

[1-5. Measurement of Reverse Transfer Influence Suppression]

[1-5-1. Measurement Method]

Effects obtained by embodiments of the invention are confirmed. To confirm suppression degree of the influence of the reverse transfer through the correction of the developing voltage, measurements were performed on the following two items.

Figure 5:
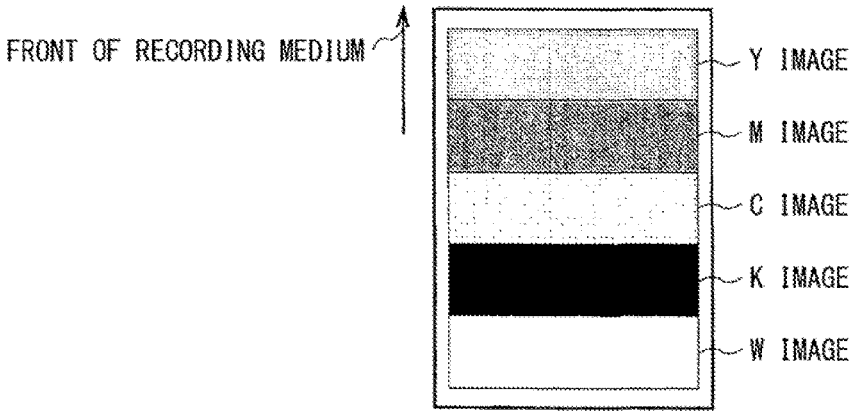
FIG. 5 is a diagram illustrating a print image pattern.

Measurement 1: the weight of the toner attached to the intermediate transfer belt 30 immediately before the secondary transfer Measurement 2: the density of the image printed on the recording medium P An image pattern in which the area of the image having an YMCKW printing rate of 100% was 20% of the entire printable region as illustrated in FIG. 5 was printed on A3 paper with use of an A3 color printer as the image forming apparatus 1, under an environment of 23° C. in temperature and 50% in relative humidity.

In Measurement 1, the operation of the image forming apparatus 1 was stopped immediately before the toner images having been subjected to the primary transfer reached the secondary transferring section 42, and the weight of the toner attached on the intermediate transfer belt 30 per unit area was measured.

In Measurement 2, the following medium A and medium B were used and the image density on the medium A and the medium B were measured.

Medium A: "Excellent White" A3, 80 g/m$^2$ (available from Oki Data Corporation located in Tokyo, Japan)

Medium B: "Irojoushitsu" thick (color fine paper thick), A3 blue (available from Hokuetsu Kishu Paper Co., Ltd. located in Tokyo, Japan)

The image density of each of the colors YMCK was measured from the medium A, and the image density of the color W was measured from the medium B. The image density of the W image was measured in a state in which black paper was laid under the medium B. Note that the image density as used herein refers to a reflection density of the toner image represented by an OD value that is an index of optical density. Thus, the density is high as the value is larger for the YMCK image, and the density is high as the value is smaller for the W image.

Measurement 1 and Measurement 2 were carried out under the conditions of Experiment 1, Experiment 2, and Experiment 3.

Experiment 1: the measurements were carried out under the conditions of 230 mm/s, 150 mm/s, and 84 mm/s for the belt traveling velocity in the printing mode (1)

Experiment 2: the measurements were carried out under the conditions of 230 mm/s, 150 mm/s, and 84 mm/s for the belt traveling velocity in the printing mode (2)

Experiment 3: the measurements were carried out under the condition of 230 mm/s for belt traveling velocity in the printing mode (1) and the printing mode (5)

[1-5-2. Measurement Results According to Method Employed in Comparative Example]

First, measurement results according to a method employed in a comparative example without the correction of the developing voltage are illustrated for comparison with embodiments of the invention.

[1-5-2-1. Experiment 1]

Figure 6:
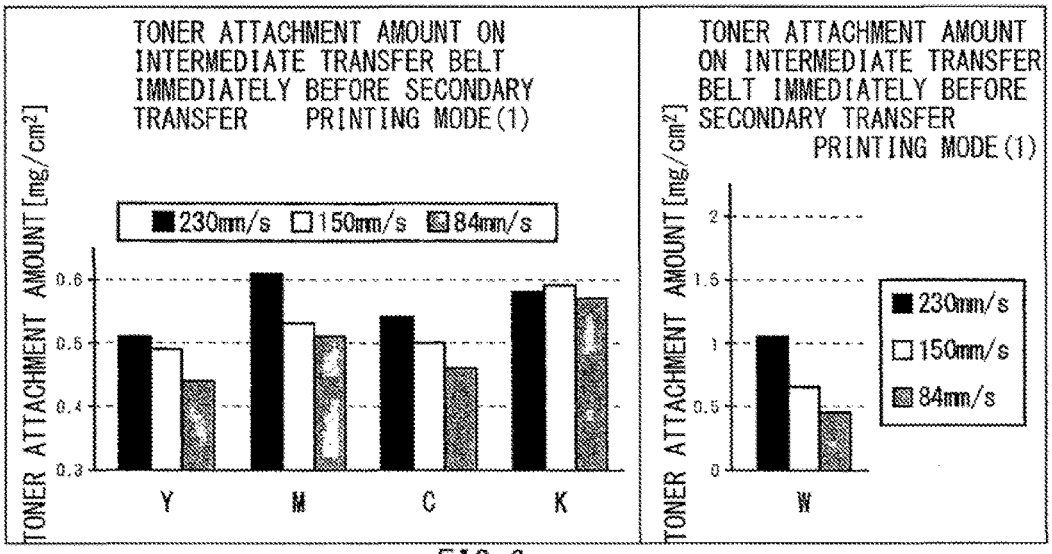
FIG. 6 is a graph illustrating results of Measurement 1 performed in Experiment 1 according to a method employed in a comparative example.

FIG. 6 illustrates result of Measurement 1 according to Experiment 1. A graph for the YMCK toners and a graph for the W toner are separated for the reason that the W toner is larger in specific gravity than the YMCK toners. In Measurement 1, the toner attachment amount was decreased as the belt traveling velocity was decreased in all of the colors other than the color K. The decrease in the toner attachment amount was due to the reverse transfer. The toner attachment amount of the color K was not decreased substantially for the reason that the other image forming units 10 were not placed downstream of the image forming unit 10K and the reverse transfer did not occur on the toner of the color K accordingly.

Figure 7:
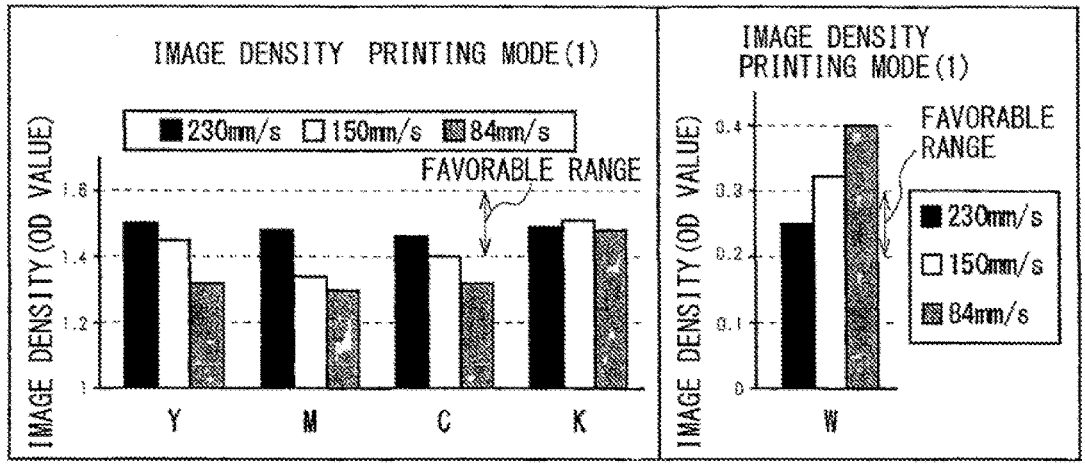
FIG. 7 is a graph illustrating results of Measurement 2 performed in Experiment 1 according to the method employed in the comparative example.

FIG. 7 illustrates results of Measurement 2 according to Experiment 1. A graph for the YMCK toners and a graph for the W toner are separated for the reason that the YMCK toners and the W toner are largely different in target density from each other. In Measurement 2, the toner managed to reach the secondary transferring section 42 was decreased as the belt traveling velocity was decreased in the colors other than the color located at the most downstream position as illustrated in FIG. 6. Thus, the image density was decreased accordingly.

[1-5-2-2. Experiment 2]

Figure 8:
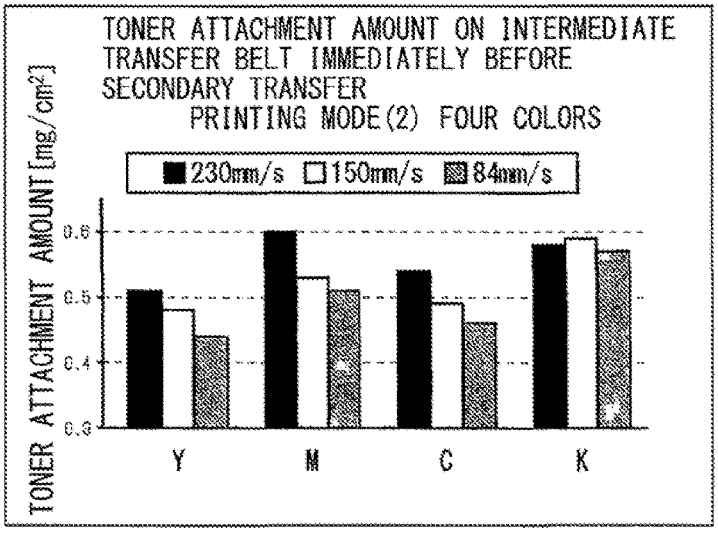
FIG. 8 is a graph illustrating results of Measurement 1 performed in Experiment 2 according to the method employed in the comparative example.

FIG. 8 illustrates results of Measurement 1 according to Experiment 2. Similar to Experiment 1, in the colors other than the color K that was placed at the most downstream position, the amount of the toner subjected to the reverse transfer was increased as the belt traveling velocity was decreased, and the toner attachment amount was decreased accordingly.

Figure 9:
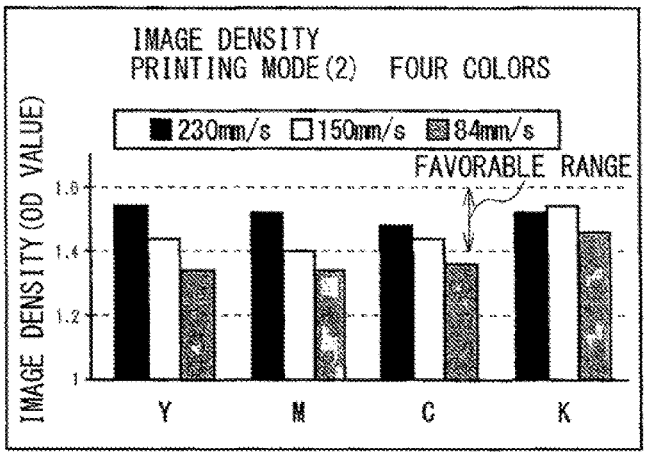
FIG. 9 is a graph illustrating results of Measurement 2 performed in Experiment 2 according to the method employed in the comparative example.

FIG. 9 illustrates results of Measurement 2 according to Experiment 2. Similar to Experiment 1, in the colors other than the color K that was placed at the most downstream position, the image density was decreased due to the reverse transfer as the belt traveling velocity was decreased.

[1-5-2-3. Experiment 3]

Figure 10:
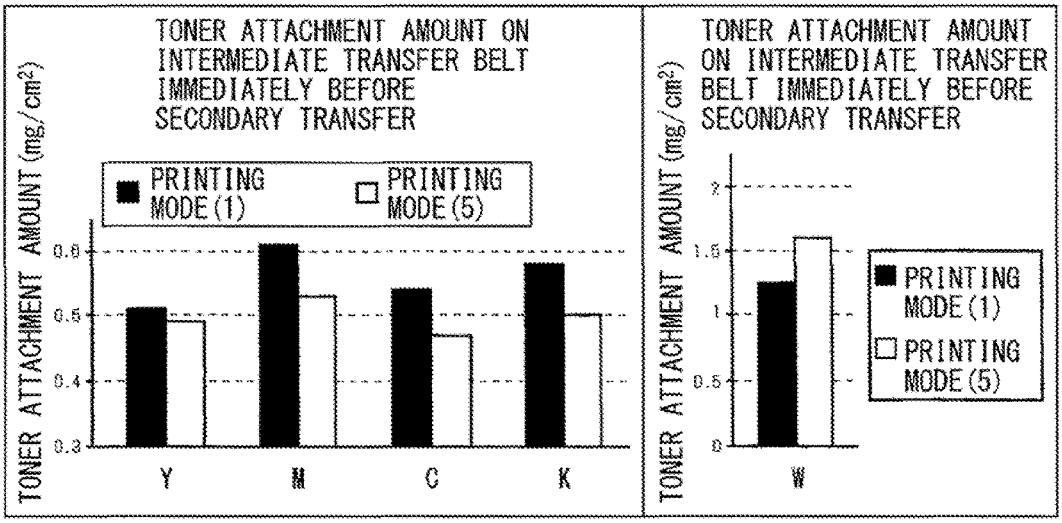
FIG. 10 is a graph illustrating results of Measurement 1 performed in Experiment 3 according to the method employed in the comparative example.

FIG. 10 illustrates results of Measurement 1 according to Experiment 3. In a case where the printing mode was changed from the printing mode (1) to the printing mode (5), the toner attachment amount was decreased in the colors YMCK, whereas the toner attachment amount was largely increased in the color W. In the case where the printing mode was changed from the printing mode (1) to the printing mode (5), the number of the other image forming units 10 that were in contact with the intermediate transfer belt 30 was increased by one on the downstream side of the image forming unit 10 of each of the colors YMCK, which increases the number of the reverse transfer by one. Thus, the toner attachment amount was decreased due to the change of the printing mode. In contrast, in the case where the printing mode was changed from the printing mode (1) to the printing mode (5) for the color W, the number of the other image forming units 10 that were in contact with the intermediate transfer belt 30 on the downstream side of the image forming unit 10W was decreased by four, which decreased the number of the reverse transfer to zero. Thus, the toner that had been collected by the reverse transfer in the printing mode (1) reached the secondary transferring section 42 directly, which largely increased the toner attachment amount in the printing mode (5) as compared with the printing mode (1).

Figure 11:
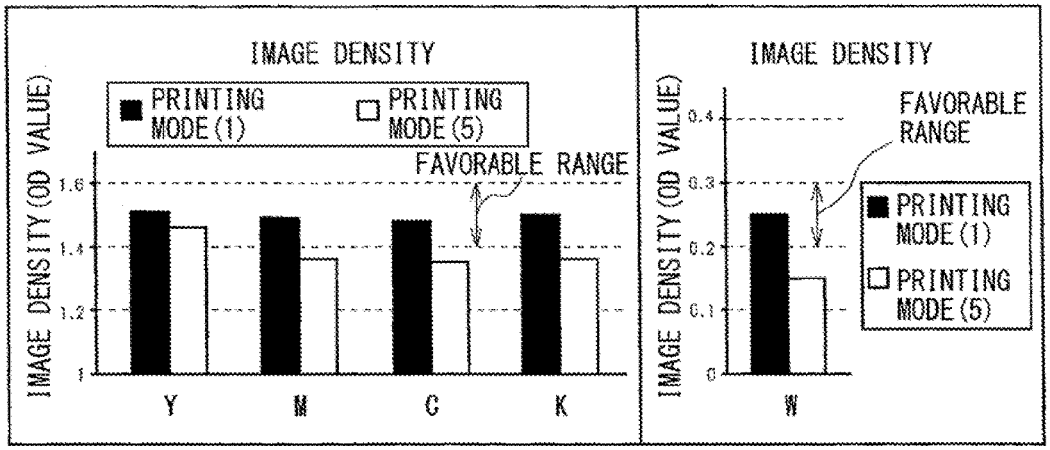
FIG. 11 is a graph illustrating results of Measurement 2 performed in Experiment 3 according to the method employed in the comparative example.

FIG. 11 illustrates results of Measurement 2 according to Experiment 3. In the case where the printing mode was changed from the printing mode (1) to the printing mode (5), the image density was decreased for the colors YMCK, and the image density was largely increased for the color W. This is because the amount of the toner to be subjected to the reverse transfer was increased or decreased due to the change in the locations of the respective image forming units 10 as illustrated in FIG. 10, and the toner attachment amount was increased or decreased accordingly.

[1-5-3. Measurement Results According to Method Employed in Present Embodiment]

Next, measurement results in a case where the correction of the developing voltage is performed as illustrated in the present embodiment are illustrated.

[1-5-3-1. Experiment 1]

Figure 12:
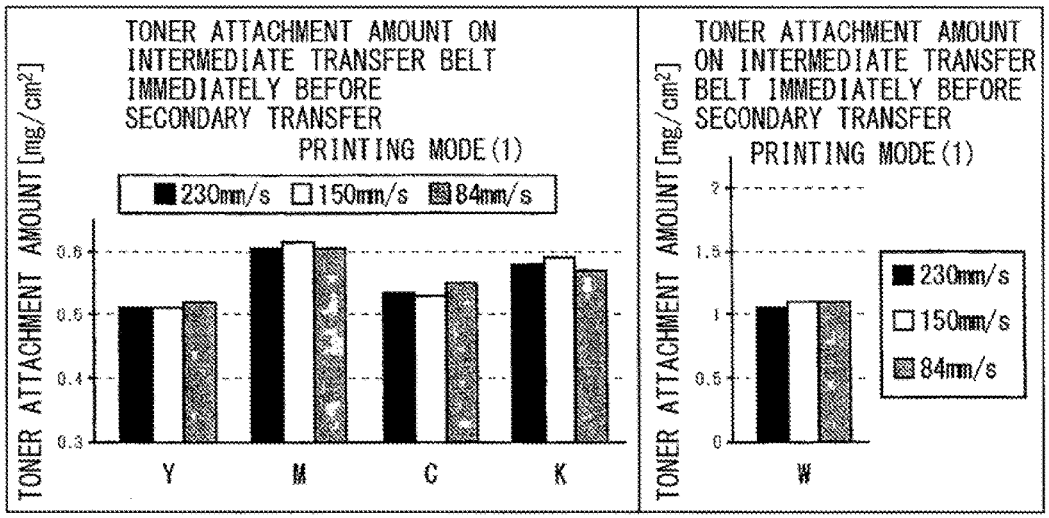
FIG. 12 is a graph illustrating results of Measurement 1 performed in Experiment 1 according to a method employed in the present embodiment.
Figure 13:
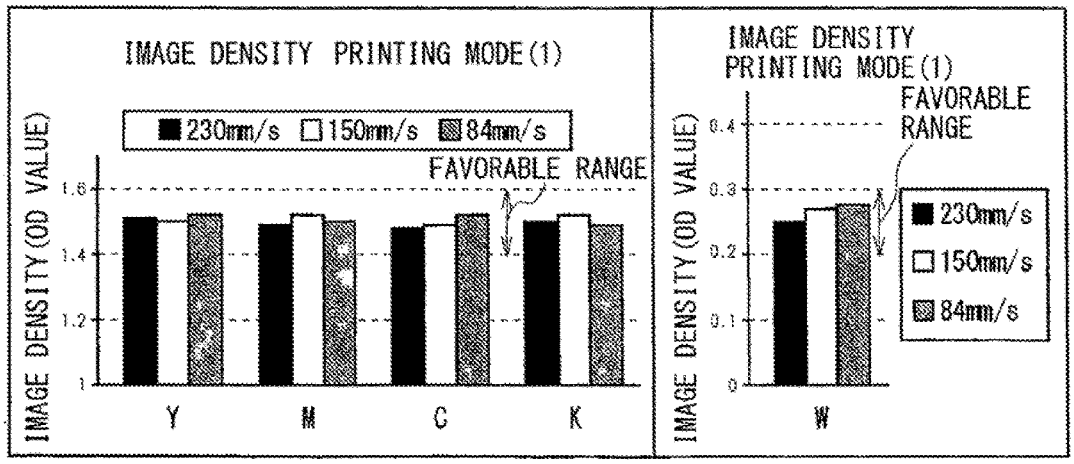
FIG. 13 is a graph illustrating results of Measurement 2 performed in Experiment 1 according to the method employed in the present embodiment.

FIG. 12 and FIG. 13 respectively illustrate results of Measurement 1 and Measurement 2 according to Experiment 1. As compared with FIG. 6 and FIG. 7 in which the correction of the developing voltage was not performed, the correction of the developing voltage suppressed an influence of the reverse transfer, and suppressed the decrease in the attachment amount of the YMCW toners even at the low belt traveling velocity. The image density fell within a favorable range due to the suppression of the influence of the reverse transfer.

[1-5-3-2. Experiment 2]

Figure 14:
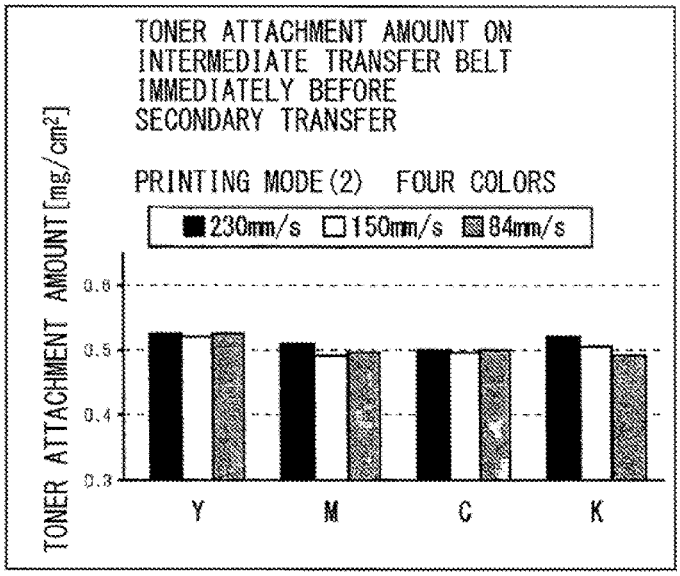
FIG. 14 is a graph illustrating results of Measurement 1 performed in Experiment 2 according to the method employed in the present embodiment.
Figure 15:
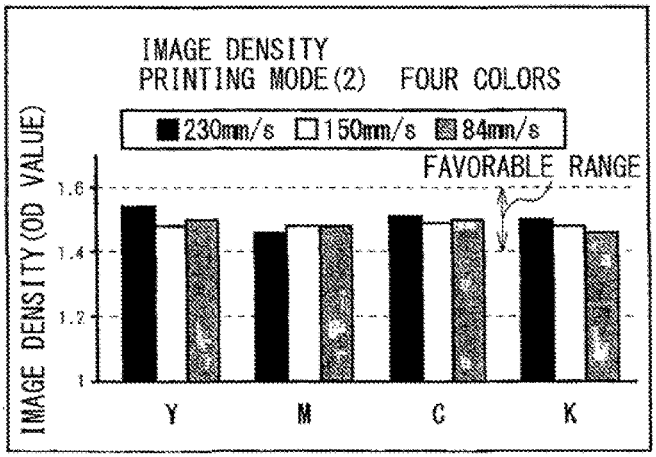
FIG. 15 is a graph illustrating results of Measurement 2 performed in Experiment 2 according to the method employed in the present embodiment.

FIG. 14 and FIG. 15 respectively illustrate results of Measurement 1 and Measurement 2 according to Experiment 2. As compared with FIG. 8 and FIG. 9 in which the correction of the developing voltage was not performed, the correction of the developing voltage suppressed an influence of the reverse transfer, and suppressed the decrease in the attachment amount of the YMC toners even at the low belt traveling velocity. The image density fell within a favorable range due to the suppression of the influence of the reverse transfer.

[1-5-3-3. Experiment 3]

Figure 16:
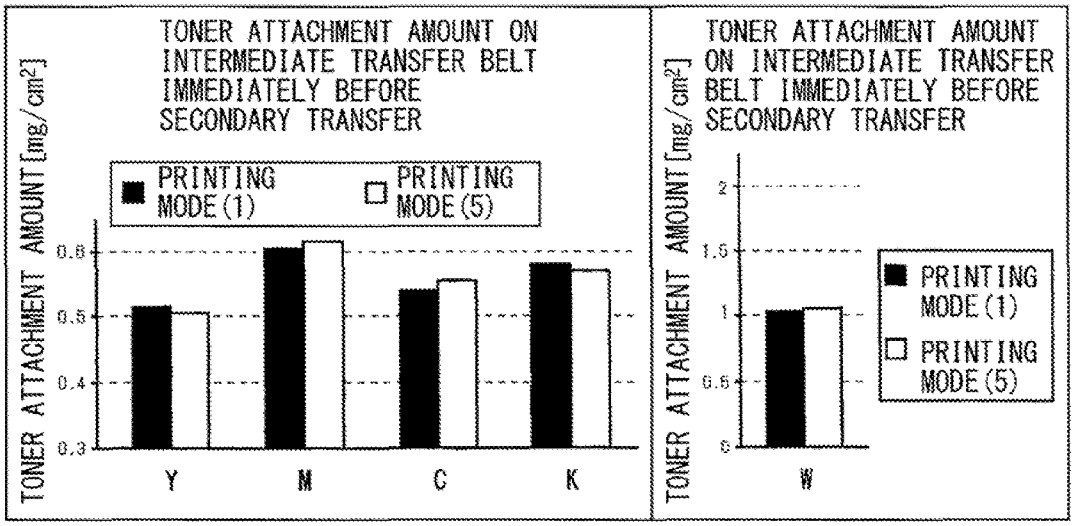
FIG. 16 is a graph illustrating results of Measurement 1 performed in Experiment 3 according to the method employed in the present embodiment.
Figure 17:
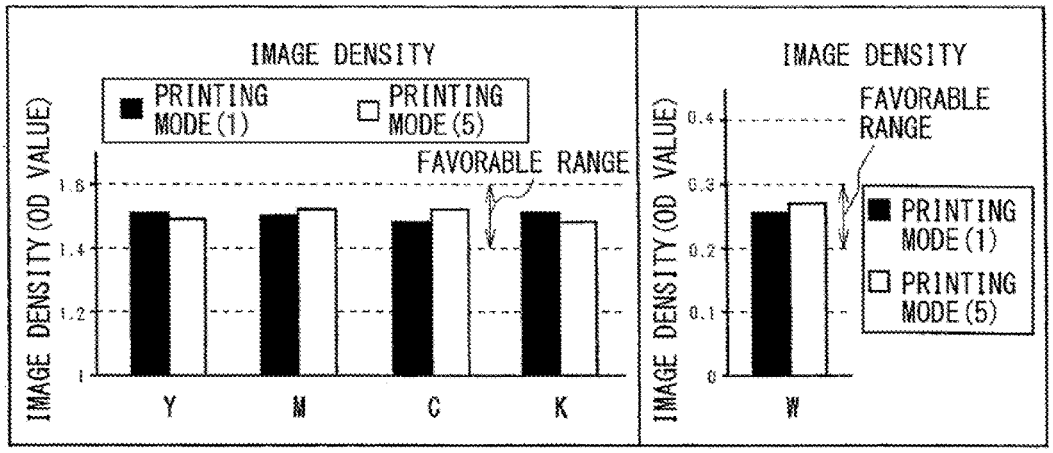
FIG. 17 is a graph illustrating results of Measurement 2 performed in Experiment 3 according to the method employed in the present embodiment.

FIG. 16 and FIG. 17 respectively illustrate results of Measurement 1 and Measurement 2 according to Experiment 3. As compared with FIG. 10 and FIG. 11 in which the correction of the developing voltage was not performed, the correction of the developing voltage suppressed an influence of the reverse transfer, and suppressed the decrease in the attachment amount of the YMCK toners and increase in the attachment amount of the W toner even when the printing mode was changed from the printing mode (1) to the printing mode (5). The image density fell within a favorable range due to the suppression of the influence of the reverse transfer.

[1-5-4. Summary]

It was confirmed from the foregoing experiments that adding the correction value to the developing voltage in accordance with the printing mode and the printing speed makes it possible to suppress the decrease in the image density caused by the reverse transfer.

[1-6. Effects, Etc.]

In the above-described configuration, the image forming apparatus 1 applies, on the basis of the printing condition, the previously-prepared correction values of the image forming condition to the colors of the toners included in the image forming units 10 provided in the respective unit enclosures 60, to the contact-separation states of the respective image forming units 10 with respect to the intermediate transfer belt 30, and to the printing speed.

More specifically, the image forming apparatus 1 selects, from the correction value storage 80, the developing voltage correction value ΔV that increases the amount of the toner to be developed onto the photosensitive drum 16 as the belt traveling velocity (the image conveying speed) of the intermediate transfer belt 30 is decreased, and thereby corrects the developing voltage. Thus, the image forming apparatus 1 compensates the toner that is transferred from the predetermined image forming unit 10 to the intermediate transfer belt 30 but is collected by the other image forming unit 10 placed downstream of the predetermined image forming unit 10 in the conveying direction, as a result of the reverse transfer that occurs a larger number of times as the belt traveling velocity is decreased.

Also, the image forming apparatus 1 selects, from the correction value storage 80, the developing voltage correction value ΔV that increase the amount of the toner to be developed onto the photosensitive drum 16 as the number of the image forming units 10 that are in contact with the intermediate transfer belt 30 is increased on the downstream side of the predetermined image forming unit 10 in the image conveying direction of the intermediate transfer belt 30, and thereby corrects the developing voltage. Thus, the image forming apparatus 1 compensates the toner that is transferred from the predetermined image forming unit 10 to the intermediate transfer belt 30 but collected by the other image forming unit 10 disposed downstream of the predetermined image forming unit 10 in the conveying direction, as a result of the reverse transfer that occurs a larger number of times as the number of the image forming units disposed downstream of the predetermined image forming unit 10 in the image conveying direction is increased.

According to the above-described configuration, the image forming apparatus 1 includes: two or more image forming units 10 each include the photosensitive drum 16 that rotates while forming an electrostatic latent image in accordance with image data and the developing roller 20 that develops a toner on the electrostatic latent image of the photosensitive drum 16; the intermediate transfer belt 30 that transfers the image developed on the photosensitive drum 16, and convey the transferred image to subsequent processes; the contact-separation mechanism 56 that changes the position of the photosensitive drum 16 to cause the photosensitive drum 16 to come into contact with the intermediate transfer belt 30 or cause the photosensitive drum 16 to be separated from the intermediate transfer belt 30; the printing operation controller 64 that controls the operation condition of the entire image forming operation; the correction value storage 80 storing the developing voltage correction values ΔV that increase the amount of the toner to be developed on the photosensitive drum 16 as the image conveying speed of the intermediate transfer belt 30 is decreased; and the image forming condition controller 72 that selects, from the correction value storage 80, the developing voltage correction values ΔV in accordance with the operation condition supplied from the printing operation controller 64 and thereby controls the image forming conditions of the respective image forming units 10. Therefore, it is possible for the image forming apparatus 1 to maintain appropriate image density irrespective of the printing condition, and to prevent from occurring the toner consumption and the standby time until the start of the printing for the image density adjustment.

One embodiment therefore allows for the appropriate image density without the occurrence of toner consumption and the downtime until start of printing, even when operation condition of the image forming apparatus is changed.

According to one embodiment of the invention, it is possible to achieve the image forming apparatus and the image forming method that allow for the appropriate image density without the occurrence of toner consumption and the downtime until start of printing, and thereby allow for improve functionality, even when operation condition of the image forming apparatus is changed.

2. Other Embodiments

Figure 18:
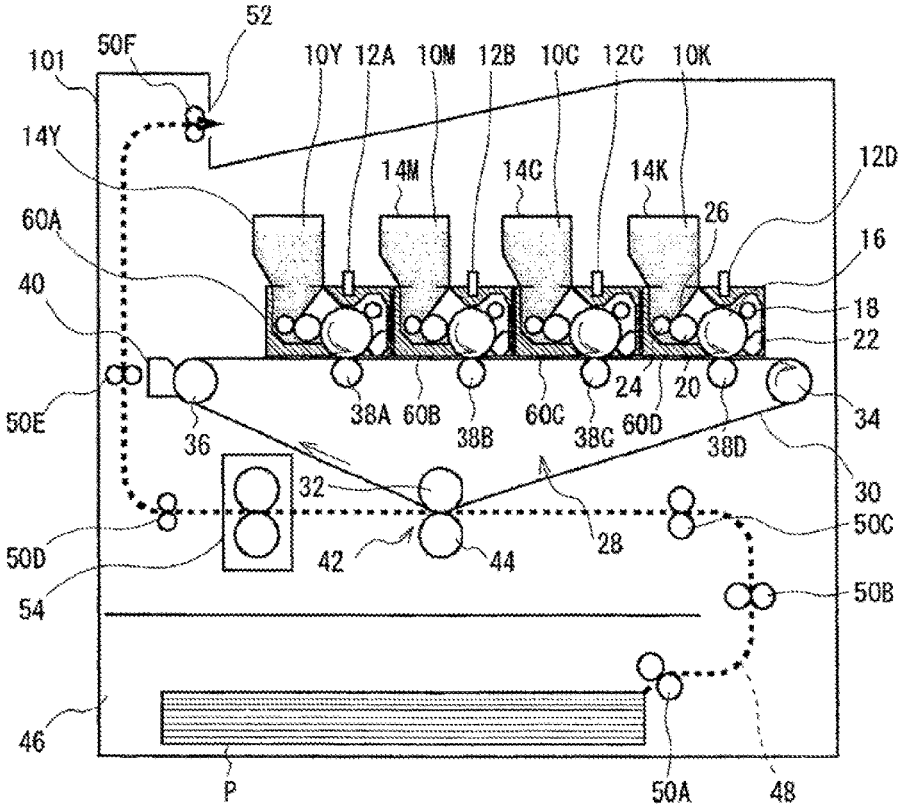
FIG. 18 is a side view illustrating a configuration of an image forming apparatus according to another embodiment.

Note that, in the above-described embodiment, an example has been described in which one embodiment of the invention is applied to the image forming apparatus 1 that is a five-color printer (FIG. 1). The invention, however, is not limited thereto. Embodiments of the invention may be applied to an image forming apparatus 101 that is a normal YMCK four-color printer without a spot-color toner, as illustrated in FIG. 18 and FIG. 2. The same reference numerals are provided to components of FIG. 18 corresponding to the components in FIG. 1. The image forming apparatus 101 is not provided with the image forming unit 10W and the unit enclosure 60E, as compared with the image forming apparatus 1. A correction value storage (not illustrated) in the image forming apparatus 101 stores a developing voltage correction value table TB101 illustrated in FIG. 19. The developing voltage correction value table TB101 includes the developing voltage correction values ΔV. The image forming apparatus 101 selects, from the developing voltage correction value table TB101, the developing voltage correction value ΔV and thereby correct the developing voltage, on the basis of the traveling velocity of the intermediate transfer belt 30 and the printing mode (the four-color printing or the monochrome printing). Thus, the image forming apparatus 101 exerts functions and effects similar to those of the image forming apparatus 1.

Also, in the above-described embodiment, an example has been described in which the toner development amount is increased or decreased through the correction of the developing voltage. The invention, however, is not limited thereto. Alternatively, the toner development amount may be increased or decreased through control of the regulating voltage, the feeding voltage, and the charging voltage, or control of the light emission amount of the LED head 12.

Further, in the above-described embodiment, an example has been described in which one embodiment of the invention is applied to the image forming apparatus 1 of the intermediate transfer system in which the toner images having been subjected to the primary transfer from the image forming units 10 to the intermediate transfer belt 30 are transferred by means of the second transfer to the recording medium P. The invention, however, is not limited thereto. Embodiments of the invention may be applied to an image forming apparatus of a direct transfer system in which toner images are directly transferred from image forming units to the recording medium P serving as a transferring member. However, the reverse transfer occurs easier from the intermediate transfer belt 30 than from the recording medium P. Thus, the effects of embodiments of the invention are more remarkably exerted in the intermediate transfer system than the direct transfer system.

Further, in the above-described embodiment, the W toner has been used as the spot-color toner other than the colors Y, M, C, and K. The invention, however, is not limited thereto. Alternatively, for example, a transparent toner, a gold toner, a silver toner, or a fluorescent toner may be used as the spot-color toner.

Further, in the above-described embodiment, an example has been described in which the image forming apparatus 1 serving as the image forming apparatus includes: the image forming unit 10 serving as the image forming section; the intermediate transfer belt 30 serving as the transferring member; the contact-separation mechanism 56 serving as the contact-separation section; the printing operation controller 64 serving as the operation condition controller; the correction value storage 80 serving as the correction value storage; and the image forming condition controller 72 serving as the image forming condition controller. The invention, however, is not limited thereto. The image forming apparatus may include an image forming section, a transferring member, a contact-separation section, an operation condition controller, a correction value storage, and an image forming condition controller each having any other configuration.

Furthermore, the invention encompasses any possible combination of some or all of the various embodiments and the modifications described herein and incorporated herein.

It is possible to achieve at least the following configurations from the above-described example embodiments of the invention.

(1) An image forming apparatus including:

an image forming section including an image supporting member and a developer supporting member, the image supporting member supporting a latent image on a surface of the image supporting member, and the developer supporting member supporting, on a surface of developer supporting member, a developer that develops the latent image;

a transferring member that transfers, onto a transferred medium as a medium on which a transfer is to be performed, an image formed by the image forming section; and a controller that controls, as an amount of the developer, a developer amount to be fed to the latent image supported on the surface of the image supporting member, on a basis of a traveling velocity of the transferred medium.

(2) The image forming apparatus according to (1), wherein the controller increases the developer amount as the traveling velocity is decreased.

(3) The image forming apparatus according to (2), wherein the controller increases the developer amount as the traveling velocity is decreased, by increasing an absolute value of a developing voltage to be applied to the developer supporting member.

(4) The image forming apparatus according to (2) or (3), wherein the image forming section further includes a charging member that charges the surface of the image supporting member, and the controller increases the developer amount as the traveling velocity is decreased, by increasing an absolute value of a charging voltage to be applied to the charging member.

(5) The image forming apparatus according to any one of (2) to (4), further including a first storage that stores the traveling velocity and a correction value of the developer amount, the traveling velocity being associated with the correction value, wherein the controller controls the developer amount by selecting, on the basis of the traveling velocity, the correction value of the developer amount stored in the first storage and using the selected correction value.

(6) The image forming apparatus according to any one of (1) to (5), wherein the image forming section includes a first image forming section and a second forming section, the second forming section being disposed downstream of the first image forming section in a traveling direction of the transferred medium.

(7) The image forming apparatus according to any one of (1) to (6), wherein the image forming section includes a first image forming section and a plurality of second image forming sections, the second image forming sections being disposed downstream of the first image forming section in a traveling direction of the transferred medium, and the controller increases the developer amount to be used in the first image forming section as the number of the second image forming sections, each including the image supporting member that is in contact with the transferred medium, is increased.

(8) The image forming apparatus according to (7), further including a second storage that stores a collection value of the developer amount and the number of the second image forming sections each including the image supporting member that is in contact with the transferred medium, the correction value being associated with the number of the second image forming sections, wherein the controller controls the developer amount by selecting, on a basis of the number of the second image forming sections each including the image supporting member that is in contact with the transferred medium, the correction value of the developer amount stored in the second storage, and using the selected correction value.

(9) The image forming apparatus according to any one of (1) to (8), further including a contact-separation section that brings the image supporting member and the transferring member into contact with each other, or causes the image supporting member and the transferring member to be separated from each other.

(10) The image forming apparatus according to any one of (1) to (9), wherein the transferred medium is an intermediate transfer belt.

(11) An image forming method, including:

forming an image by an image supporting member and a developer supporting member, the image supporting member supporting a latent image on a surface of the image supporting member, and the developer supporting member supporting, on a surface of the developer supporting member, a developer that develops the latent image;

transferring the formed image onto a transferred medium as a medium on which a transfer is to be performed; and controlling, as an amount of the developer, a developer amount to be fed to the latent image supported on the surface of the image supporting member, on a basis of a traveling velocity of the transferred medium.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

an image forming section including an image supporting member and a developer supporting member, the image supporting member supporting a latent image on a surface of the image supporting member, and the developer supporting member supporting, on a surface of developer supporting member, a developer that develops the latent image;

a transferring member that transfers, onto a transferred medium as a medium on which a transfer is to be performed, an image formed by the image forming section; and a controller that controls, as an amount of the developer, a developer amount to be fed to the latent image supported on the surface of the image supporting member, on a basis of a traveling velocity of the transferred medium, wherein the controller increases the developer amount as the traveling velocity is decreased, by increasing, toward a negative polarity, a developing voltage to be applied to the developer supporting member.

2. The image forming apparatus according to claim 1, wherein the image forming section further includes a charging member that charges the surface of the image supporting member, and the controller increases the developer amount as the traveling velocity is decreased, by increasing an absolute value of a charging voltage to be applied to the charging member.

3. The image forming apparatus according to claim 1, further comprising a first storage that stores the traveling velocity and a correction value of the developer amount, the traveling velocity being associated with the correction value, wherein the controller controls the developer amount by selecting, on the basis of the traveling velocity; the correction value of the developer amount stored in the first storage and using the selected correction value.

4. The image forming apparatus according to claim 1, wherein the image forming section includes a first image forming section and a second image forming section, the second forming section being disposed downstream of the first image forming section in as traveling direction of the transferred medium.

5. The image forming apparatus according to claim 1, further comprising a contact-separation section that brings the image supporting member and the transferring member into contact with each other, or causes the image supporting member and the transferring member to be separated from each other.

6. The image forming apparatus according to claim 1, wherein the transferred medium is an intermediate transfer belt.

7. The image forming apparatus according to claim 1, wherein the transferred medium comprises a recording medium.

8. An image forming apparatus comprising:

an image forming section including an image supporting member and a developer supporting member, the image supporting member supporting a latent image on a surface of the image supporting member, and the developer supporting member supporting, on a surface of developer supporting member, a developer that develops the latent image;

a transferring member that transfers, onto a transferred medium as a medium on which a transfer is to be performed, an image formed by the image forming section; and a controller that controls, as an amount of the developer, a developer amount to be fed to the latent image supported on the surface of the image supporting member, on a basis of a traveling velocity of the transferred medium, wherein the image forming section includes a first, image forming section and a plurality of second image forming sections, the second image forming sections being disposed downstream of the first image forming section in a traveling direction of the transferred medium, and the controller increases the developer amount to be used in the first image forming section as the number of the second image forming sections, each including the image supporting member that is in contact with the transferred medium, is increased.

9. The image forming apparatus according claim 8, further comprising a second storage that stores a collection value of the developer amount and the number of the second image forming sections each including the image supporting member that is in contact with the transferred medium, the correction value being associated with the number of the second image forming sections, wherein: the controller controls the developer amount by selecting, on a basis of the number of the second image forming sections each including the image supporting member that is in contact with the transferred medium, the correction value of the developer amount stored in the second storage, and using the selected correction value.

10. The image forming apparatus according to claim 8, wherein the controller increases the developer amount as the traveling velocity is decreased.

11. The image forming apparatus according to claim 8, further comprising a contact-separation section that brings the image supporting member and the transferring member into contact with each other, or causes the image supporting member and the transferring member to be separated from each other.

12. The image forming apparatus according to claim 8, wherein the transferred medium comprises a recording medium.

13. An image forming apparatus comprising:

an image forming section including an image supporting member and a developer supporting member, the image supporting member supporting a latent image on a surface of the image supporting member, and the developer supporting member supporting, on a surface of developer supporting member, a developer that develops the latent image;

a transferring member that transfers, onto a transferred medium as a medium on which a transfer is to be performed, an image formed by the image forming section; and a controller, wherein the image forming section includes a first image forming section and a plurality of second image forming sections, the second image forming sections being disposed downstream of the first image forming section in a traveling direction of the transferred medium, and the controller increases a developer amount to be used in the first image forming section as a number of the second image forming sections, each including the image supporting member that is in contact with the transferred medium, is increased.

14. The image forming apparatus according claim 13, further comprising a second storage that stores a collection value of the developer amount and the number of the second image forming sections each including the image supporting member that is in contact with the transferred medium, the correction value being associated with the number of the second image forming sections, wherein: the controller controls the developer amount by selecting, on a basis of the number of the second image forming sections each including the image supporting member that is in contact with the transferred medium, the correction value of the developer amount stored in the second storage, and using the selected correction value.

15. The image forming apparatus according claim 13, wherein the controller increases the developer amount as the traveling velocity is decreased.

16. The image forming apparatus according claim 13, the image forming apparatus according to claim 1, further comprising a contact-separation section that brings the image supporting member and the transferring member into contact with each other, or causes the image supporting member and the transferring member to be separated from each other.

17. The image forming apparatus according claim 13, wherein the transferred medium comprises a recording medium.

18. The image forming apparatus according claim 13, wherein the controller increases the developer amount to be used in the first image forming section, by increasing, toward a negative polarity, a developing voltage to be applied to the developer supporting member, as the number of the second image forming sections, each including the image supporting member that is in contact with the transferred medium, is increased.

* * * * *